United States Patent [19]

Murphy et al.

[11] Patent Number: 4,691,920

[45] Date of Patent: Sep. 8, 1987

[54] ELECTRONIC HOCKEY GAME

[76] Inventors: Dale P. Murphy, 863 Cliffside Dr., Akron, Ohio 44313; Paul D. Murphy, 6 E. Walnut, P.O. Box 266D, Frankfort, Ohio 44628

[21] Appl. No.: 817,549

[22] Filed: Jan. 10, 1986

[51] Int. Cl.[4] ..... A63F 7/06

[52] U.S. Cl. ..... 273/85 A; 273/85 G; 273/DIG. 28

[58] Field of Search ..... 273/85 R, 85 A, 85 G, 273/121 A, 88, DIG. 28

[56] References Cited

U.S. PATENT DOCUMENTS

| | | | |
|---|---|---|---|
| 2,964,320 | 12/1960 | Lebrun | 273/85 A |
| 4,173,338 | 11/1979 | Barnett | 273/85 R |
| 4,342,454 | 8/1982 | Baer et al. | 273/85 G |
| 4,448,417 | 5/1984 | Clark et al. | 273/121 A |
| 4,480,833 | 11/1984 | Barcelow et al. | 273/126 A |

*Primary Examiner*—Leo P. Picard

*Attorney, Agent, or Firm*—Oldham, Oldham & Weber Co.

[57] ABSTRACT

A plurality of playing figures (B) are rotatably mounted on a generally planar playing surface (A). By pivoting levers of figure control linkages (C), the players selectively rotate the figures. Arrays of light emitting diodes are selectively actuatable to assume an optically more visible state to define visible paths between individual figures and goal areas of the playing surface. An electric control (E) selectively causes the light emitting diodes to define readily visible paths between the figure which has scored a goal and the goal area, as well as between the scoring figure and one or more assisting figures. That is, the action is temporarily suspended and a schematic representation of replay of the scoring action is provided. Further, the control circuit includes a voice chip which provides audio responses such as crowd noise, cheers, boos and the like in response to the nature and rate of action on the playing surface. The electronic control is connected with figure/playing piece sensors and goal sensors for monitoring the action on the playing surface.

20 Claims, 13 Drawing Figures

ELECTRONIC HOCKEY GAME

BACKGROUND OF THE INVENTION

The present application relates to an invention described in application Ser. No. 504,950, now abandoned, in the electromechanical game and amusement device art area. The invention finds particular application in conjunction with coin-operated, electromechanical hockey games and will be described with particular reference thereto. It is to be appreciated, however, that the present invention is also applicable to hockey, soccer, rugby, football, lacrosse, and other action games and amusement apparatus.

Heretofore, there have been numerous hockey games. Commonly, the hockey games included a generally planar playing surface upon which a plurality of figures representing hockey players were rotatably mounted. Half of the figures were connected by mechanical linkages with control handles at one end of the playing surface and the other half were connected with control handles at the other end. In this manner, each player was able to manipulate half of the figures. Goals were defined at each end of the playing surface. In some instances, the goal included an aperture through the playing surface into which the playing piece fell into a return. Electronic goal sensors sensed the passage of the playing piece through the goal and incremented a corresponding score display. Some prior art hockey games further included a timer for timing the period and providing a display of the time left in each period. Other prior art hockey games provided a cyclic crowd noise which unrelated to the actions on the playing surface and, consequently, sounded artificial and "canned".

These prior art hockey games like other mechanical and electromechanical games and amusements lacked an easily and quickly read instant replay capability. Frequently, action and scoring occurred so fast that the players had difficulty determining just how the scoring had transpired. Further, many of the prior art games have been relatively unrealistic since they provided little audio stimulation. If any crowd noise was provided, it was "mechanical" and did not correspond to the game action.

The present invention contemplates a new and improved mechanical action game with audio responses variably keyed to the action and an instant schematically represented replay display showing each scoring play.

SUMMARY OF THE INVENTION

In accordance with the present invention, there is provided a generally planar playing surface. A plurality of playing figures are mounted adjacent the playing surface for rotational movement. Each of the figures has a figure sensing means for electronically sensing interaction between the figure and a playing piece. A figure control means controls the rotational movement of the figures. A goal sensing means electronically senses the passage of the playing piece into at least one goal area defined on the playing surface. Path means selectively define optically visible paths. The paths extend schematically from at least some of the figures to the goal area and between figures. Each path has a more readily visible state and a less visible state. An instant replay means causes the path between the last figure to contact the playing piece before the playing piece passes into the goal area and the goal area to assume its more readily visible state in response to the playing piece being sensed by the goal sensing means.

In accordance with another aspect of the invention, the replay means further causes paths between the last, the penultimate, and the antepenultimate figures to contact the playing piece before the score to assume their more readily visible states.

In accordance with yet another aspect of the invention, an audio means is provided for providing preselected variable audio responses to the scoring, saves by the goalie, rapid action, and other preselected sequences of play.

An advantage of the present invention is that it provides an instant schematic representation of a replay to illustrate each successful score.

Another advantage of the present invention is that it provides variable audio stimulation in coordination with the play on the playing surface.

Still further advantages of the present invention will become apparent to others upon reading and understanding the following detailed description of the preferred embodiment.

BRIEF DESCRIPTION OF THE DRAWINGS

The invention may take form in various parts and arrangements of parts. The drawings are only for purposes of illustrating a preferred embodiment of the invention and are not to be construed as limiting it.

BEST MODE FOR CARRYING OUT THE INVENTION

The mechanical action game includes a generally planar playing surface A upon which a plurality of playing figures B are movably mounted. Figure control means C control movement of the figures.

A path means D selectively defines a plurality of optically visible schematic paths between individual figures and goal areas of the playing surface. An electronic control means E selectively causes the path means to define readily visible schematic paths between the goal and the figure which has scored a goal as well as between one or more assisting figures and the scoring figure.

The electronic control circuit is unique in that it also provides variable audio responses such as crowd noise, cheers, boos, and the like in response to the nature and rate of action on the playing surface. Various audio responses may be provided, such as a chorus of "defense, defense" in response to the goalie contacting the playing piece a plurality of times in a relatively short time span, a chorus of cheers in response to scoring a goal, a chorus of boos and Bronx cheers in response to a team scoring on itself, increasing in the level of the crowd noise as the rate of contact between the playing piece and the figures increase, and the like.

With particular reference to FIGS. 1, 2, 3, and 4, the generally planar playing surface A is constructed of a translucent material, such as opaque, white plastic. The playing surface slopes from a central portion generally toward first and second goal means 10 and 12, respectively, disposed at opposite ends of the playing surface. A peripheral wall 14 surrounds the playing surface such that a playing piece 16 is confined thereto.

Figure 1:
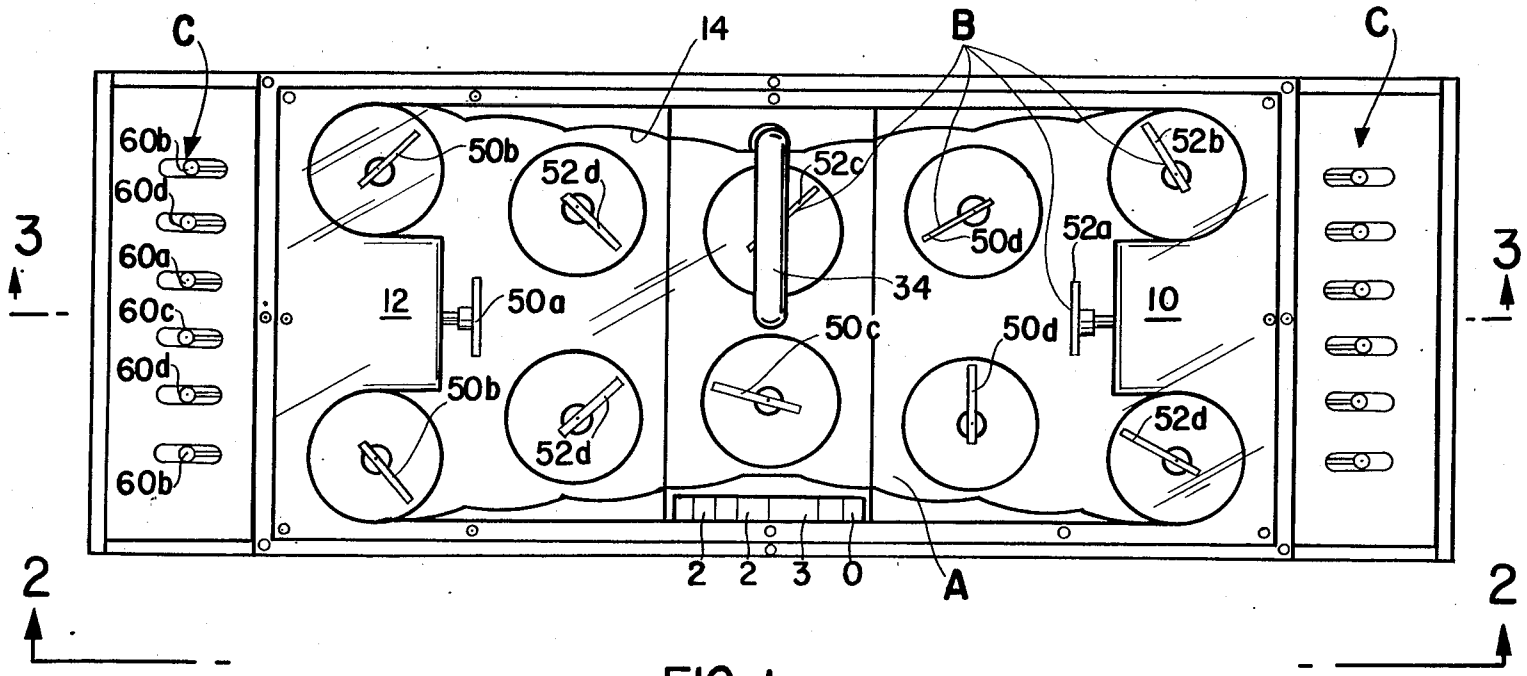
FIG. 1 is a top view of an amusement apparatus in accordance with the present invention including a playing surface and figures in an arrangement particularly adapted for hockey.
Figure 2:
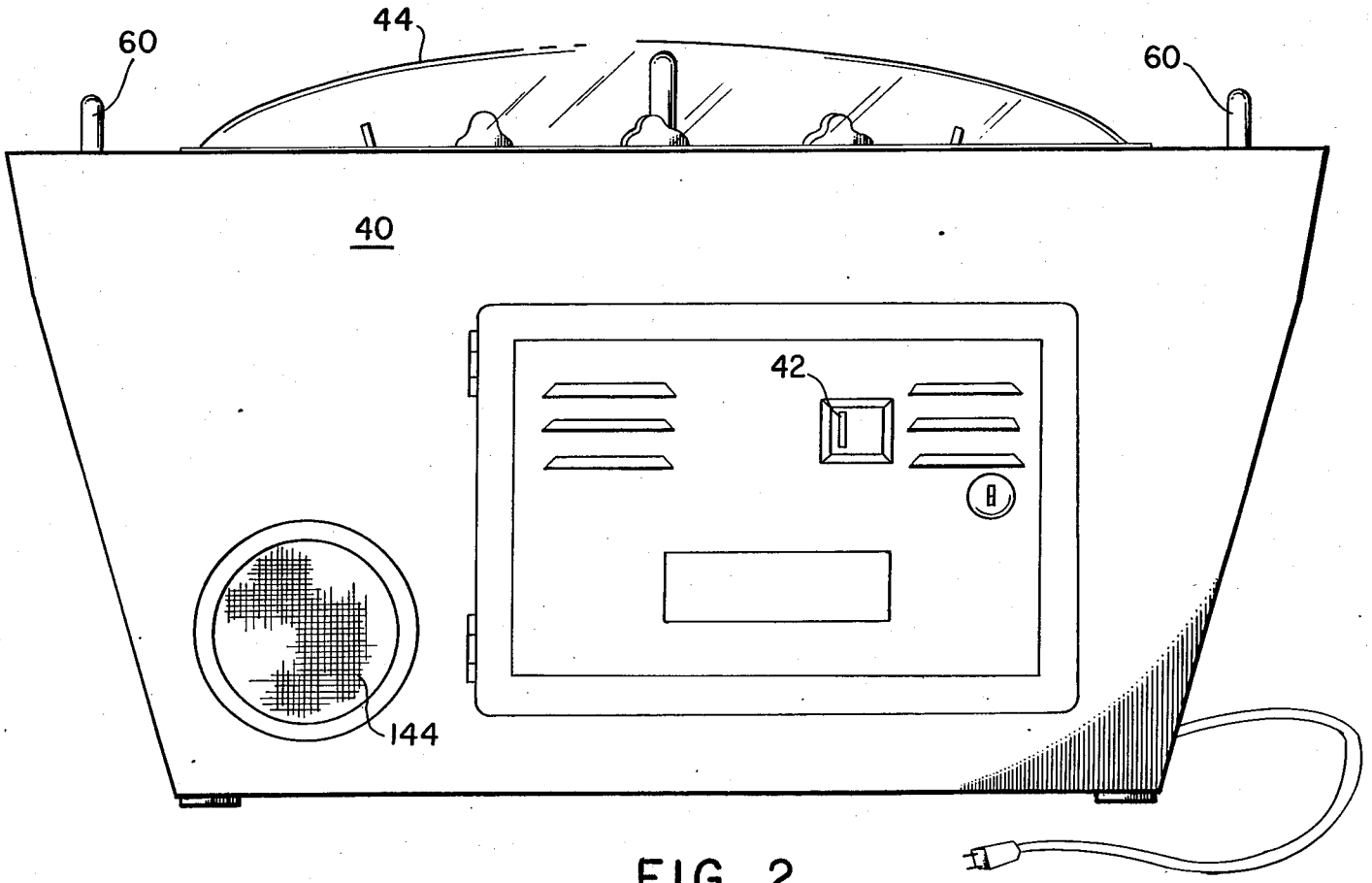
FIG. 2 is a front elevational view of the amusement apparatus of FIG. 1.
Figure 3:
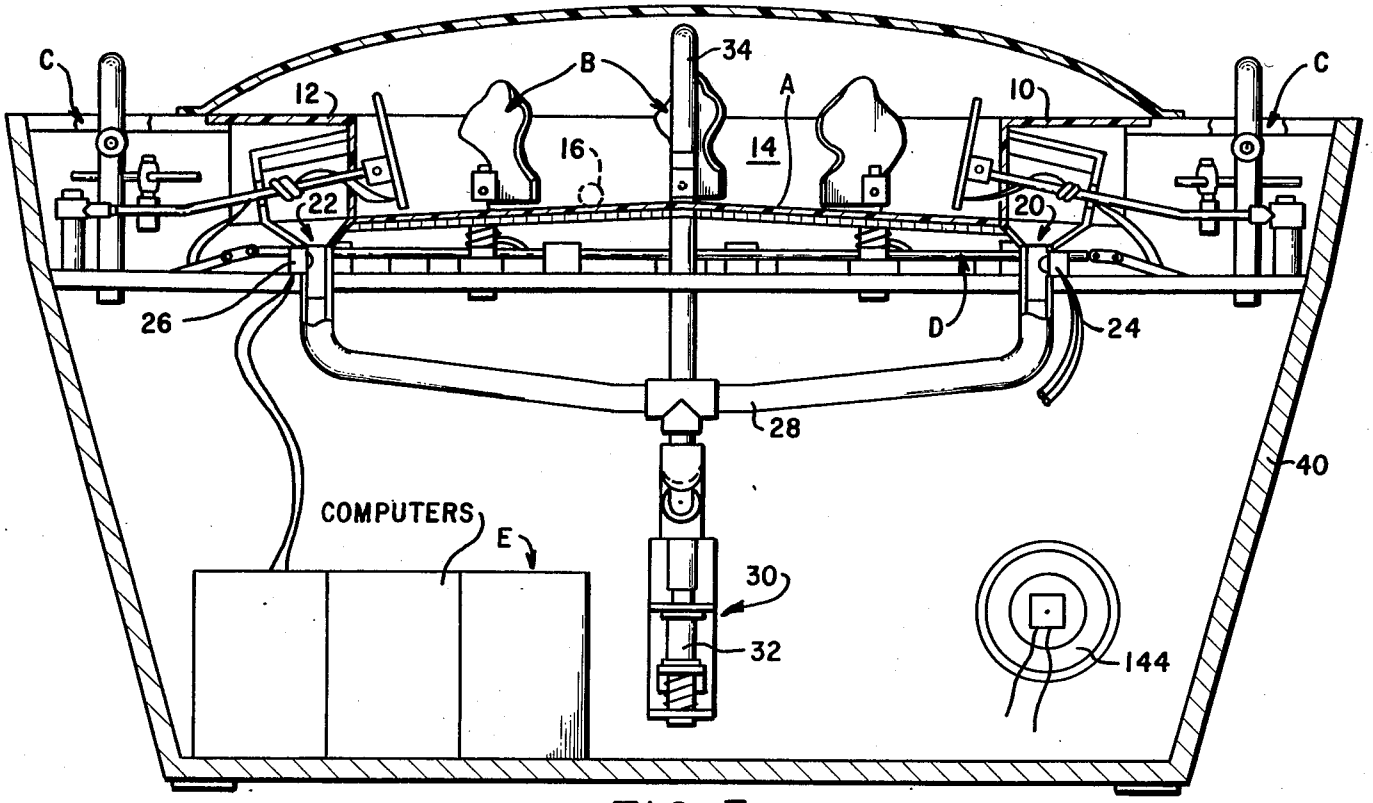
FIG. 3 is a sectional view through section 3—3 of FIG. 1.

With particular reference to FIG. 3, the goal means 10 and 12 define apertures 20 and 22, respectively, through the play surface. Goal sensing means, such as contact switches 24 and 26 are closed as the playing piece passes thereby. An arrangement of playing piece carrying tubes 28 convey the playing pieces to an ejection mechanism 30. The ejection mechanism includes a solenoid 32 which selectively propels the playing piece through a tube 34 to the center of the playing surface for a face-off.

The playing surface is housed in a surrounding house 40 in which a coin mechanism 42 is mounted. A clear plastic dome 44 covers the playing surface such that the players cannot physically interact with the playing mechanism.

Figure 7:
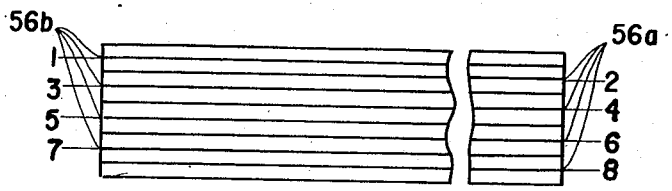
FIGS. 7 and 8 illustrate a figure/playing piece interaction sensor.
Figure 8:
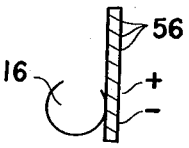

With particular reference to FIGS. 1, 3, 5, and 6, a first plurality or team of FIGS. 50 and a second plurality or team of FIGS. 52. Particularly, each team includes a goalie figure 50*a*, 52*a*, a pair of wings 50*b*, 52*b*, a center 50*c*, 52*c*, and a pair of forwards 50*d*, 52*d*. Each figure includes a figure sensing means 54 for sensing contact between the figure and the playing piece. With particular reference to FIGS. 7 and 8, the figure sensing means of the preferred embodiment includes a tape strip which has exposed, closely spaced electrical conductive strips 56. More specifically, alternate electrically conductive strips 56*a* form one side of a switch and intermediate electrically conductive strips 56*b* form the other contact. When the metal playing piece 16 contacts the figure sensing means, it forms a part of the conductive path closing the switch and providing an indication of a figure/playing piece interaction.

Figure 5:
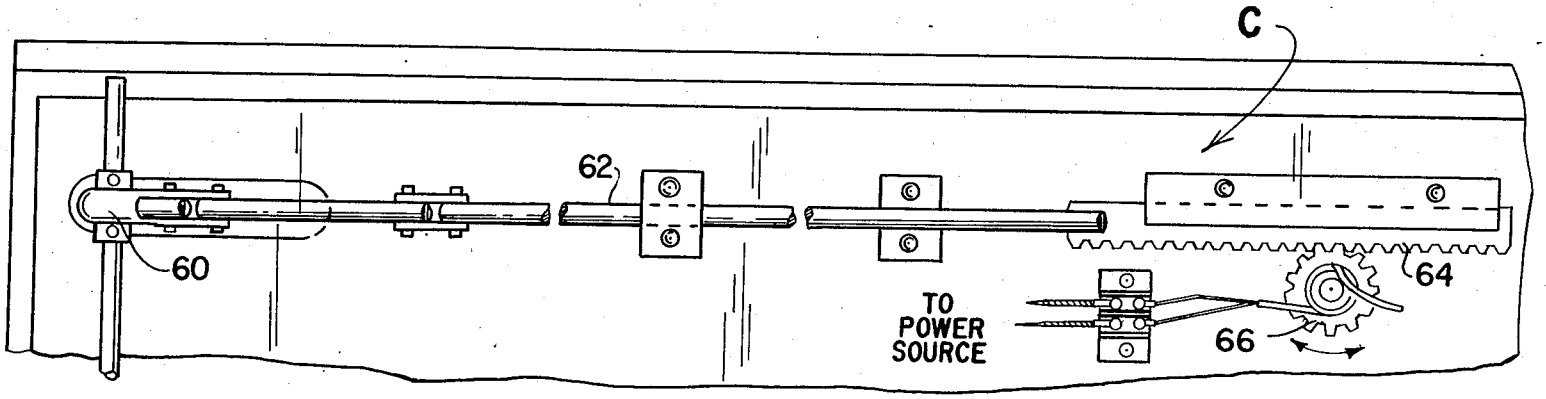
FIGS. 5 and 6 illustrate mechanical linkage for controlling movement of the rotatable figures.
Figure 6:
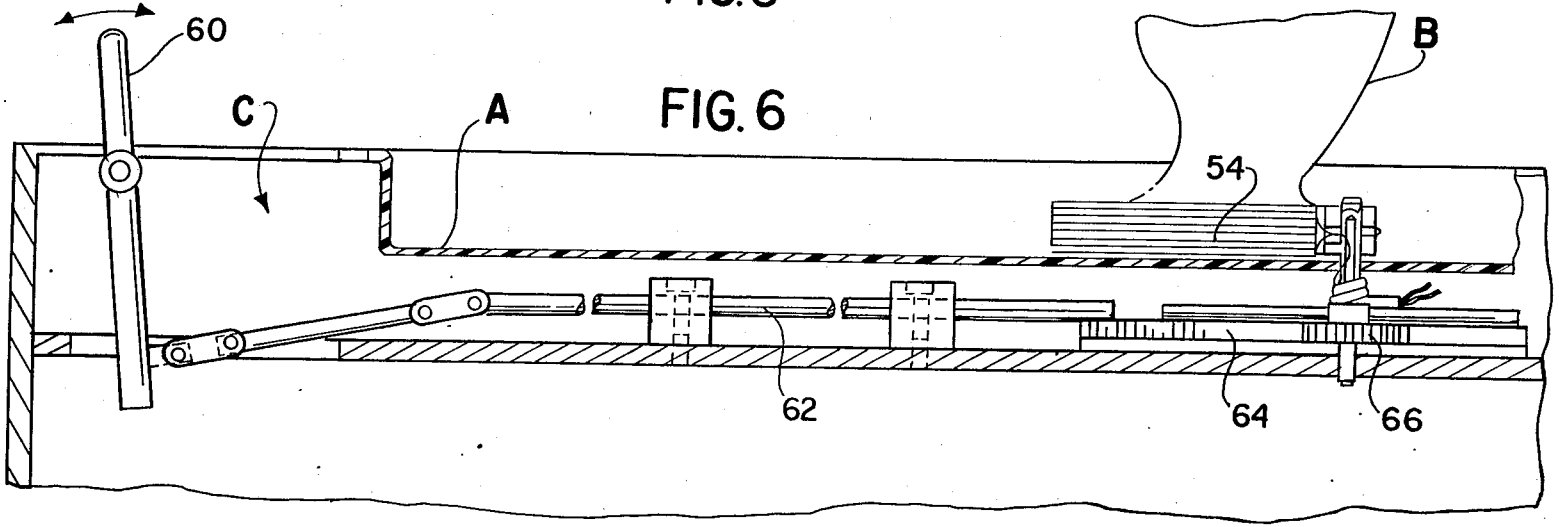

With particular reference to FIGS. 5 and 6, the figure control means C includes a plurality of levers 60 which are pivotally mounted for fore and aft movement. The control lever 60 is connected by a flexible linkage 62 with a rack gear 64. The rack gear 64 engages a pin gear 66 which is connected with one of the wing, center or forward figures. In this manner, tipping the control lever forward and aft selectively rotates the associated wing, center, or forward figure. More specifically, control levers 60*b* control the wings 50*b*, control levers 60*c* control the center 50*c*, and control levers 60*d* control the forwards 50*d*.

Figure 9:
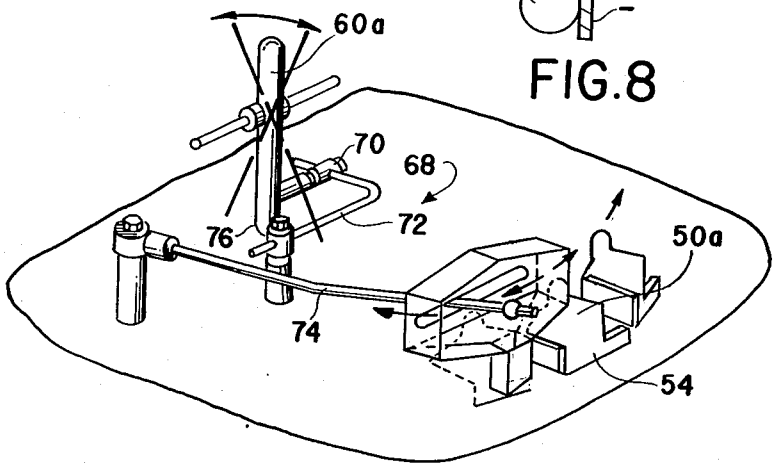
FIG. 9 illustrates mechanical linkage for controlling side-to-side movement of the goalie.
Figure 4:
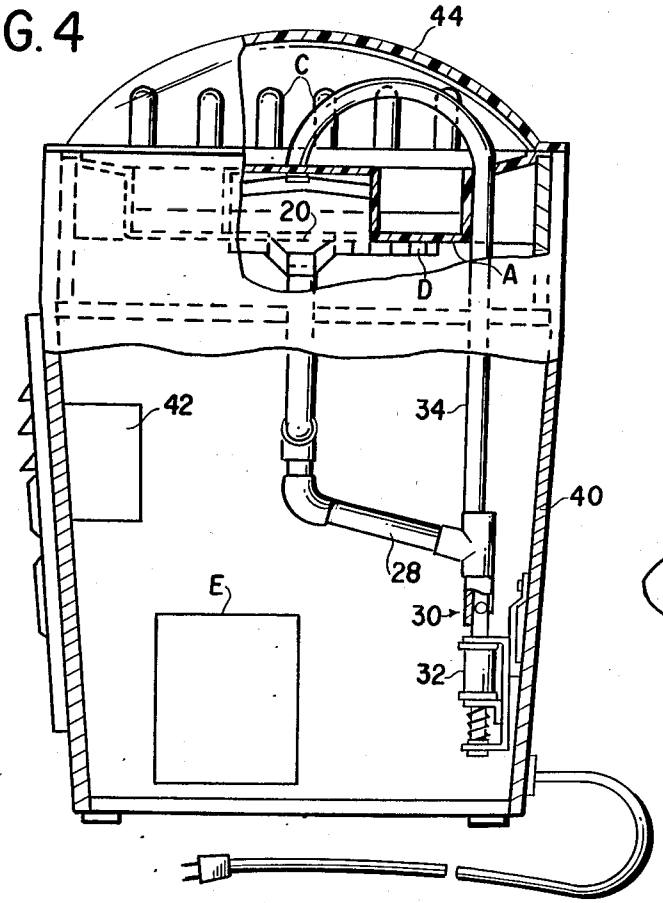
FIG. 4 is a side elevational view of the amusement apparatus of FIG. 1 in partial section.

With particular reference to FIG. 9, a mechanical linkage 68 extending between the goalie control lever and the goal converts forward and aft pivoting movement into side-to-side goalie movement In the preferred embodiment, a goalie lever 60*a* moves a universal joint 70 forward and aft and with it an associated 90° connecting link 72. The connecting link 72 is slidably connected with an angularly disposed goalie control rod 74 by a universal joint 76. In this manner, forward and aft pivotal movement of the goalie control lever 60*a* causes the goalie FIG. 50*a* to be moved side-to-side.

Figure 10:
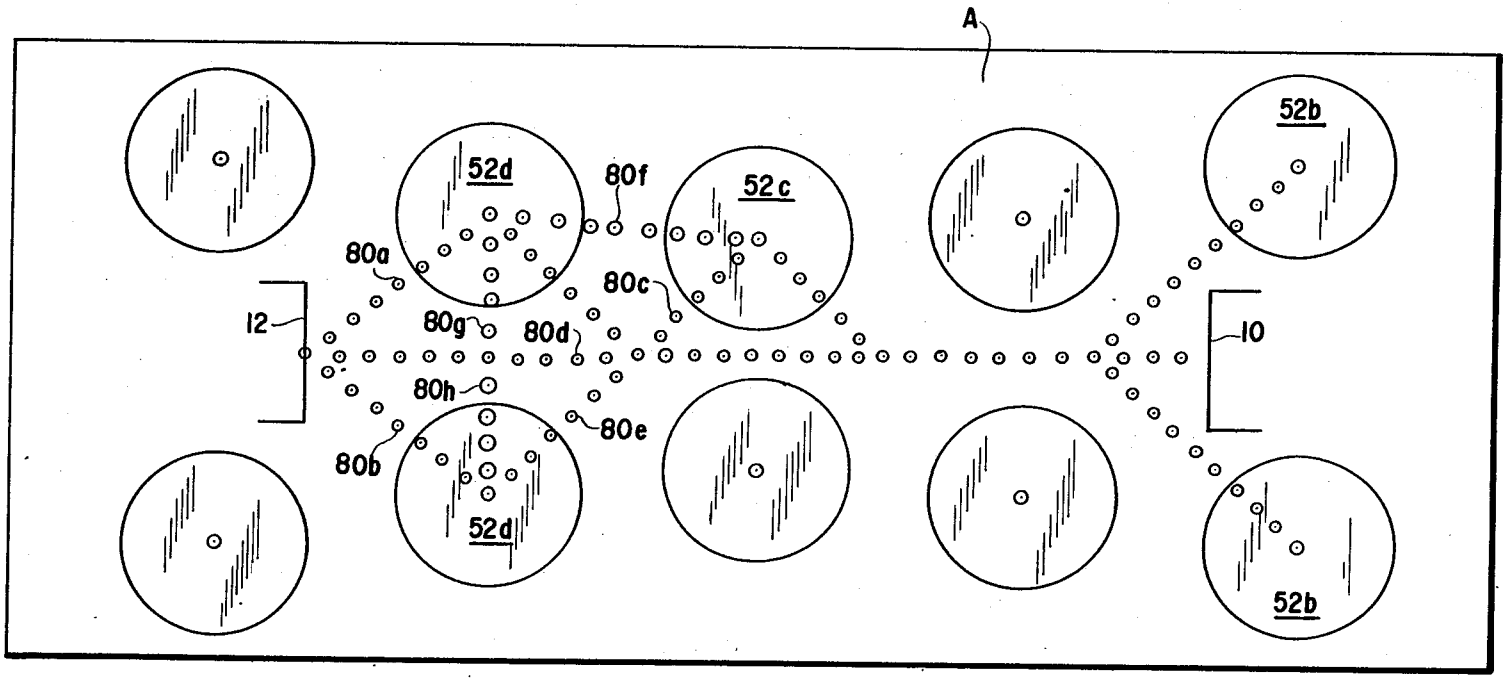
FIG. 10 is a top plan view of the playing surface illustrating a placement of LED schematically represented replay paths.

With particular reference to FIGS. 3 and 10, the path means D includes means for defining visible straight paths, in schematic line fashion from above the playing surface between the various figures on each team and the goal area which they are attacking. In the preferred embodiment, the path means includes a plurality of linear arrays of light emitting diodes (LED's). For example, the diode arrays define paths 80*a* and 80*b* extending between the forwards 52*d* and the attacked goal area 12. By illuminating the diodes of one of the paths 80*a* or 80*b*, one can indicate in schematic fashion that the associated forward scored the goal. By schematic is meant that the path of lights does not indicate the precise path of travel of the playing piece, but is simply a schematic or diagramatic representation of such path of travel. Such a representation is superior to an exact replay since it is many times actually easier and quicker to visually comprehend a schematic representation than a precise replay.

Similarly, arrays 80*c* and 80*d* define a path between the center 52*c* and the attacked goal to indicate that the center has scored. Similarly, arrays 80*c* and 80*e* connect the center and one of the forwards to show an assist and array 80*f* connects the center with the other forward for showing an assist. Arrays 80*g* and 80*h* connect the forwards, also for showing an assist. Analogously, additional arrays of light emitting diodes connect the forward and center with the wings and goalie for indicating assists or goals scored thereby. Optionally, other path means may be provided between the figures and the attacked goal. For example, each linear light emitting diode array could be replaced by a cylinder having a colored strip axially along its surface. By rotating the colored strips toward the playing surface, an optically visible path can be denoted. In yet another option, each linear array could be replaced by an elongated filament light tube or bulb. Each of the path means has a more visible state and a less visible state. In the case of light emitting diodes, the more visible state is when the diodes are illuminated and the less visible state is when the diodes are off. Similarly, with the rotatable cylinders, the more visible state is with the colored strip rotated toward the playing surface and the less visible state is with the color strip rotated away from the playing surface. Preferably, the playing surface and the path means are constructed such that the path is not visible through the playing surface in its less visible state.

Figure 11A:
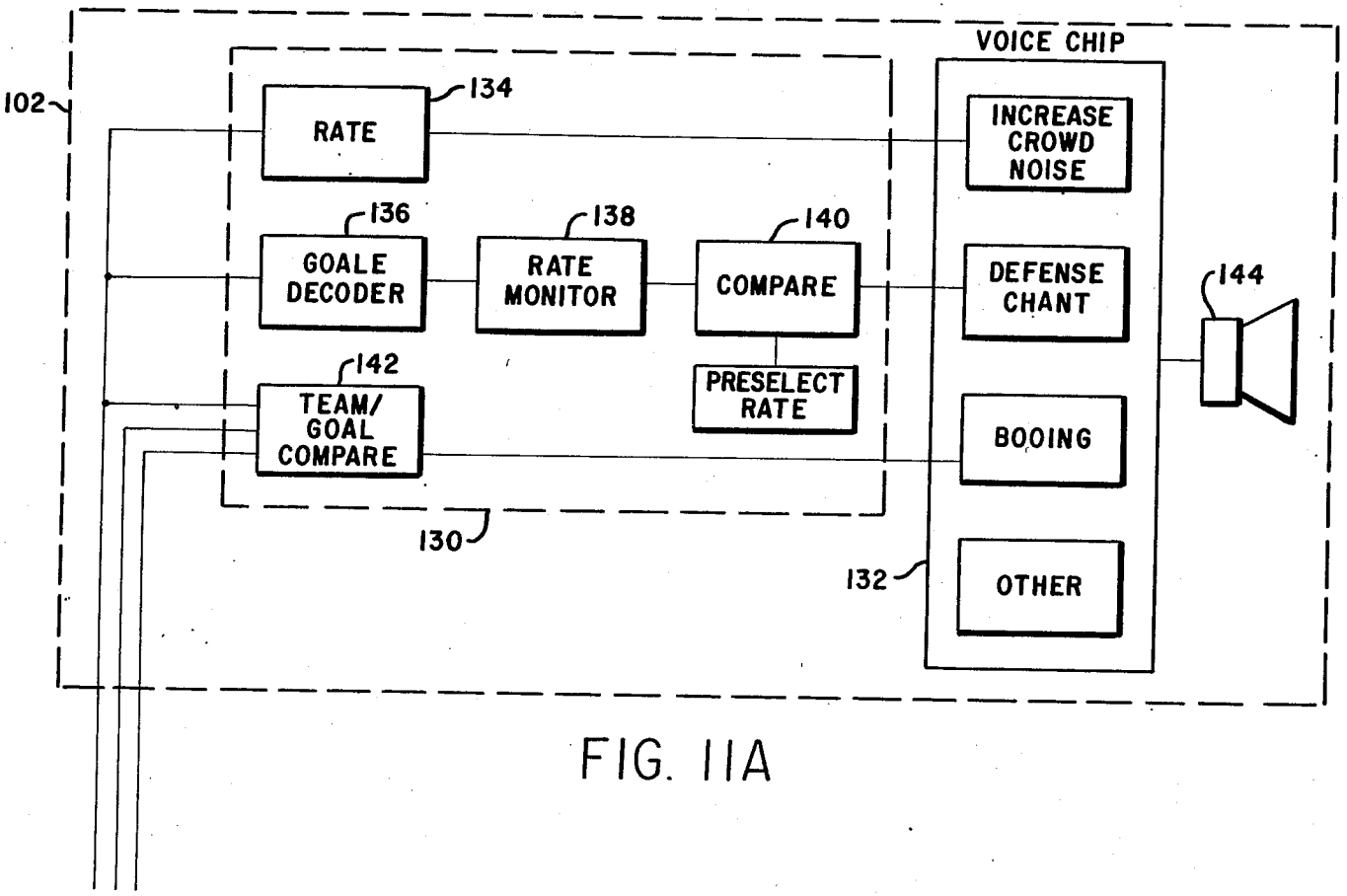
FIGS. 11A, 11B and 11C are a diagrammatic illustration of control circuitry in accordance with the present invention.
Figure 11B:
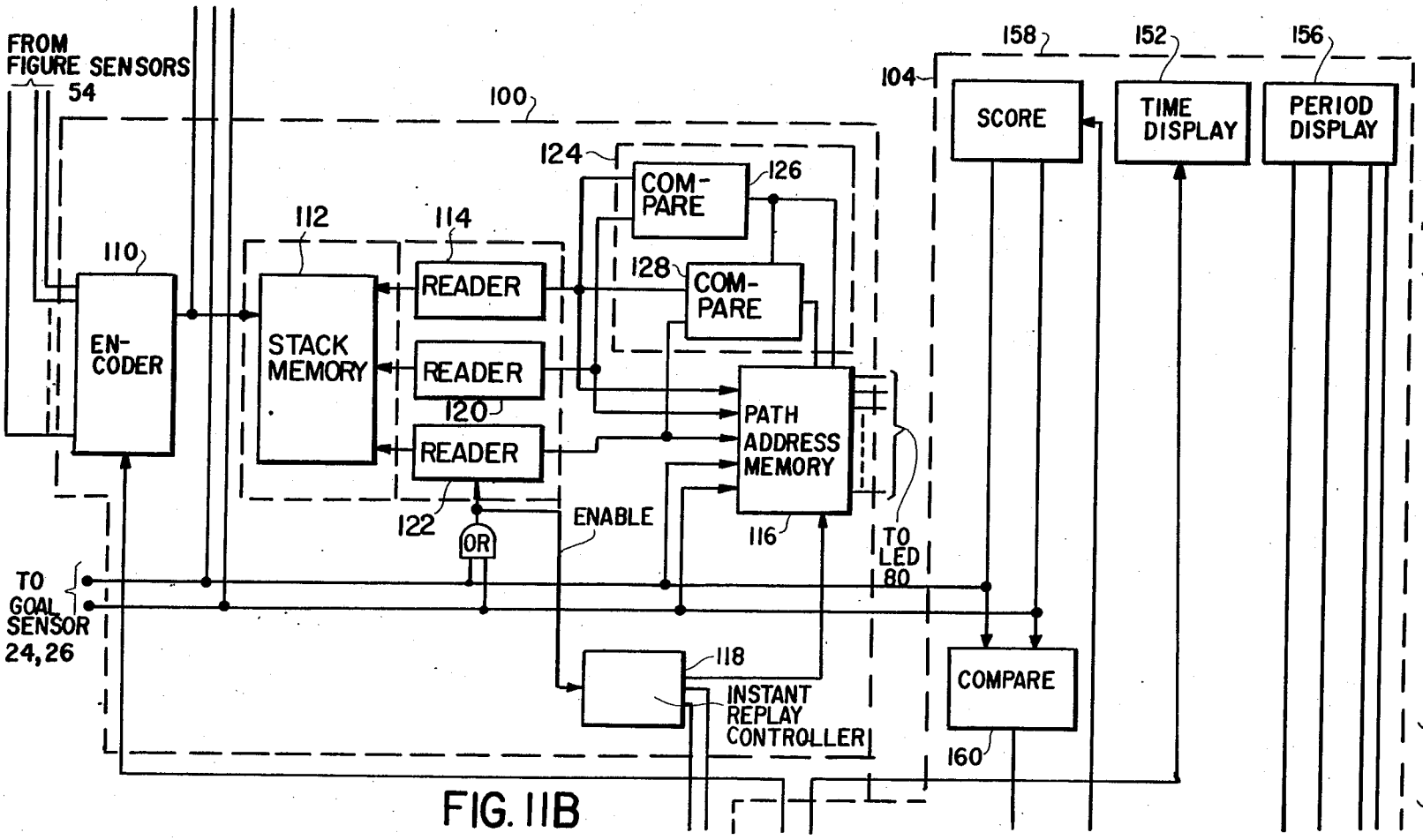
Figure 11C:
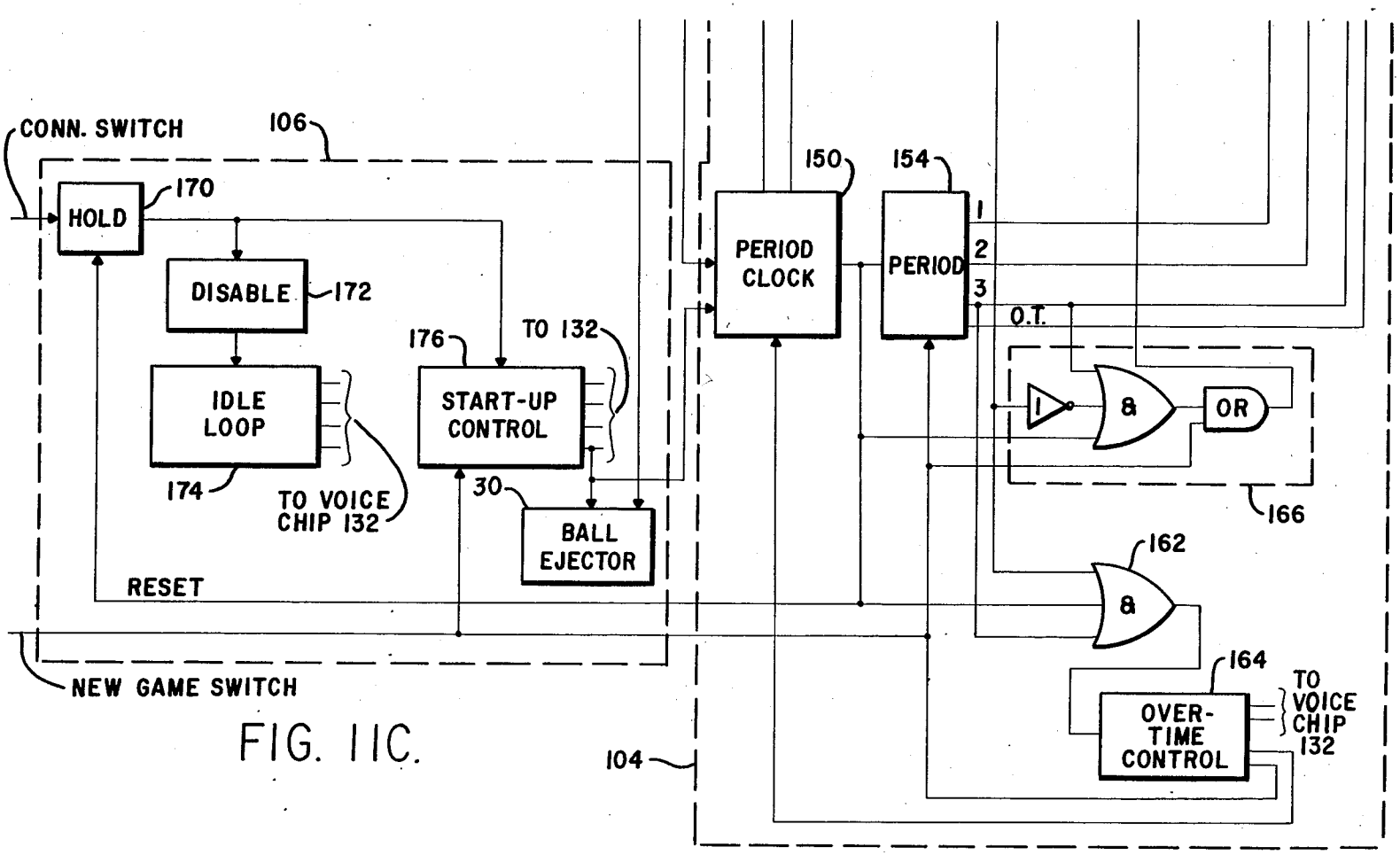

With reference to FIGS. 11A, B and C, a three part diagram of the electronic control circuit E is provided. A schematic replay means 100 provides an instant schematic representation of replay of each successful score. Variable audio response means 102 provides a variable audio response to selected action conditions, both nature and rate. A time and score means 104 monitors the playing time and goal sensing means 24 and 26 and provides a visual display thereof. A coin control means 106 provides basic control functions in response to being actuated by receipt of a coin or other start switch.

The schematic replay means 100 includes an encoder 110 which is connected with each of the figure sensing means 54. The encoder produces a digital indication of each figure that contacts the playing piece. Preferably, the first bit of the encoded designation indicates the figures team. A stacking memory means 112 stores a preselected plurality of the encoded figure designations in the order received. In the preferred embodiment, the stacking memory stores three figure designations, i.e. the designation of the last figure, the penultimate figure and the antepenultimate figure to contact the playing piece. Each time another figure contacts the playing piece, a new last figure designation is added, the other designations shift down one notch, and the former antepenultimate designation is dropped.

A score means 114 such as a reader or memory retrieval means is enabled in response to a signal from the goal sensing means 24, 26 to read the designation of the last figure to have contacted the playing piece before the goal and figure designations into a command to the appropriate light emitting diode array or other path means extending between the last contacted figure and the goal. Analogously, an assist means includes a reader means 120 which reads the penultimate contacted figure designation and a reader means 122 which reads the antepenultimate contacted figure designation. The path address memory means 116 determines which light emitting diode arrays form a path between the penultimate and last contacted figures and between the antepenultimate and penultimate contacted figures. More specifically, the last and penultimate contacted figures mark the end points of a line path extending therebetween. From the end points, the path address memory 116 determines the interconnecting line path.

An edit means 124 limits assists to figures on the same team. Specifically, a comparing means 126 compares the team identifying bits of the last and penultimate contacted figure designations. The comparing means 126 enables the path between the penultimate and last figure. Further, when the team designations are the same, the output from the comparing means 126 enables a comparing means 128 which compares the team designations of the last and antepenultimate contacted figures. If the comparing means 128 determines that the last and antepenultimate contacted figures are on the same team, it enables the path address memory 116 to determine the path extending therebetween. An instant replay controller 118 causes the path memory to provide actuating outputs to each LED of the path means in order from the antepenultimate contacted figure, to the penultimate contacted figure, to the last contacted figure, to the goal such that movement of the playing piece is suggested. Further, the diode arrays are actuated twice to provide a first and a second instant replay. During the instant replay, the controller dims house lights above the playing surface, rendering the path means more readily visible. After the instant replays, the controller causes the playing piece ejector 30 to provide another face-off.

The realism of the game is greatly enhanced by variable audio simulation, the intensity and nature of which corresponds to the rate and nature of play action. Such variable audio responses are achieved by audio means 102 connected with the figure sensing means 54, or more specifically, the encoder 110 so as to receive the encoded designations of each figure contacting the playing piece. The audio means is further connected with the goal sensing means 24, 26 for monitoring the action on the playing surface more completely. The audio means 102 includes a board action response means 130 for selecting one of a plurality of preselected audio outputs from an audio means or voice chip 132 in response to corresponding preselected board action. The action response means includes a rate monitoring means 134 which monitors the rate at which contacting figure designations are received. The rate means 134 controls the volume or level of background crowd noise generally in proportion to the rate of figure/playing piece contact. Optionally and preferably, the rate means 132 may also compare the rate of figure contacting with preselected levels such that the voice chip 134 superimposes additional cheers, whistles, and the like on the crowd noise when the action exceeds a preselected level. The response means also includes a decoder 136 for detecting the goalie designations. A rate means 138 monitors the rate at which goalie designations are decoded by the goalie decoder. A comparing means 140 compares the goalie rate from the rate means 138 with a preselected rate. When the goalie rate exceeds the preselected rate, the comparing means 140 causes the voice chip 132 to start a "defense" chant encouraging the goalie. Preferably, the goalie figures of the two teams are designated by the same code varying only by the team indicating bit. The response means 130 further includes a team/goal comparing means 142 for determining whether a team scored upon itself. More specifically, the team/goal comparing means 142 compares the team designation of the last contacted player with the designation of the goal at which the score took place. Optimally, the team/goal comparing means 142 may exclude goalies from comparison such that deflected shots which still score do not produce the round of booing that occurs when a team scores on itself. The voice chip 132 responds to the commands from each of the response means as well as from other portions of the control circuit as described herein below, to cause an electroacoustic transducer 144 to produce a preselected sequence of audio tones, sounds, pauses, and the like.

The timing and scoring means 104 includes a period clock 150 which times the periods of the hockey game. In the preferred embodiment, the period clock times a two minute game, considered a hockey playing period. In the event players elect to play two additional games, or "periods"—real hockey games contain three periods—and the score is tied at such point, the clock automatically times a thirty second sudden death overtime period. The period clock is enabled by the control means 106 at the beginning of a game or period and is disabled by the instant schematic replay means 100 during an instant schematic replay cycle. More specifically, the instant replay control means 118 disables the period clock for preselected pause duration after each goal is scored. The pause duration is selected to coincide with the duration of the instant replay. The period clock controls a visual display on an optical time display means 152. At the end of each period, the period clock indexes a period counter 154. The period counter 154 is connected with an optical period display means 156 for providing an optical display of the period in progress. A score display means 158 provides an optical display of the current score. An overtime determining means includes a comparing means 160 for determining when the score is tied. Further, an end means 162 determines when the third period has been completed and the score is tied. The end means causes an overtime control means 164 to restart the period clock for a thirty second overtime period and causes the voice chip 132 to produce a preselected chain of syllables. Specifically, the voice chip is enabled to produce preselected verbal instructions regarding the play of the overtime period and background crowd noises. A score display zeroing means 166 zeroes the score display at the end of the third period provided the score is not tied or in response to one of the players depressing a new game button. That is, some players may choose to play less than a full three periods. Accordingly, a new game button is provided so that the players may zero the score and return the period indicator to the first period.

The control means 106 includes a hold circuit 170 which is actuated by the closing of a coin-operated switch 42 to produce a high output signal. The high output signal causes a disable means 172 to disable an idle loop means 174. The idle loop means 174 when enabled produces a series of commands to the voice chip 132 such that a predetermined cycle of audio outputs are provided. Specifically, the idle loop causes the voice chip to produce a preselected series of audio outputs which are designed to draw attention to the game and stimulate its use. When a player has placed a coin in the slot, the disable means 172 disables the idle loop as a start-up control 176 is actuated. Once actuated, the start-up control first produces a preselected series of outputs to the voice chip. These outputs cause the voice chip to give instructions to the players. At the end of the instructions, the start-up control produces an output which (1) starts or enables the period clock 150, (2) causes the playing piece ejector 30 to eject the playing piece onto the playing surface, and (3) causes the voice chip 132 to announce the face-off.

For simplicity of illustration, the control circuit has been described with a block diagram illustrating various means, functions, and steps performed by the control circuit. Preferably, the control circuit is implemented with a microprocessor programmed to implement the above-described functions. Various additional functions may, of course, be added. For example, during an instant replay, the response means may include means for translating the player code of the scoring and assisting players and for causing the voice chip 132 to announce the figures who scored and assisted. Further, a plurality of potential responses may be provided to some or all of the situations. A selecting means may be provided for cyclically or randomly selecting one of the possible audio responses to each situation.

While in accordance with the patent statutes, a preferred embodiment and best mode has been presented, the scope of the invention is not limited thereto, but rather is measured by the scope of the attached claims.

What is claimed is:

1. A mechanical action game apparatus comprising:

a generally planar playing surface;

a plurality of playing figures mounted adjacent the playing surface for movement relative thereto, each figure having a figure sensing means for electronically sensing interaction between the figure and a playing piece;

figure control means for controlling movement of the figures relative to the playing surface, whereby the figures are adapted to move the playing piece around the playing surface;

goal means for defining at least one goal area in conjunction with the playing surface;

goal sensing means for sensing passage of the playing piece into the goal area;

path means for selectively defining a plurality of optically visible straight paths, at least some of the paths extending from at least some of the figures to the goal area, each path having at least a more readily visible state and a less visible state; and means for schematic representation of action replay causing at least one of the paths to assume its more visible state in response to the goal sensing means sensing passage of the playing piece into the goal, the schematic representation means including scoring means for determining which figure last contacted the playing piece before the playing piece passed into the goal area, and for directing the instant schematic representation means to cause a path which extends between the last contacted figure and the goal area to assume its more visible state, the schematic representation means being operatively connected with the figure sensing means, the goal sensing means and the path means, whereby after each goal is scored an instant schematic replay is provided to show which figure scored.

audio response means providing a preselected sequence of audio sounds which vary in composition, intensity and rate, depending upon the type and rate of play action.

2. The apparatus as set forth in claim 1 wherein the playing surface is translucent and the path means is disposed thereunder such that the paths are selectively viewable therethrough.

3. The apparatus as set forth in claim 2 wherein the path means includes a plurality of linear arrays of light means extending along an underside of the playing surface, at least some of the linear arrays extending from at least some of the figures to the goal area such that illuminating the light means between the last contacted figure and the goal area defines a more readily visible straight path therebetween.

4. The apparatus as set forth in claim 3 further including sequencing means for causing individual light means in each linear array to be illumiated sequentially from the last contacted figure and the goal area, whereby movement from the last contacted figure to the goal area is schematically represented.

5. The apparatus as set forth in claim 3 wherein the individual light means are light emitting diodes.

6. The apparatus as set forth in claim 5 further including a matrix of light emitting diodes disposed adjacent the playing surface underside, the linear arrays including linearly arranged subsets of the light emitting diode matrix.

7. The apparatus as set forth in claim 3 further including peripheral arrays of light means surrounding each of a plurality of figures, the schematic representation means further causing the peripheral array of light means surrounding the last contacted figure to become illuminated contemporaneously with illuminating the linear array of light means along the path between the last contacted player and the goal area.

8. The apparatus as set forth in claim 1 wherein the schematic representation means further includes assist means for determining the penultimate figure to contact the playing piece before the playing piece passes into the goal area, the assist means being operatively connected with the figure sensing means for sensing contact between the figures and the playing piece and being operatively connected with the path means for directing the path means to cause a path between the penultimate and last contacting figure to assume its more readily visible state.

9. The apparatus as set forth in claim 8 wherein the assist means further determines the antepenultimate figure to contact the playing piece before the playing piece passes into the goal area, the assist means further directing the path means to cause a path between the antepenultimate figure and the penultimate figure to assume its more readily visible state.

10. The apparatus as set forth in claim 9 wherein the schematic representation means includes a stacking memory means for temporarily storing a designation of each figure to contact the playing piece, after each contact, the stacking memory means stores the designation of the most recently contacted figure and drops the designation of the least recently contacted figure, the score means including means for retrieving the designation of the most recently contacted figure and the assist means including means for retrieving the designations less recently contacted figures.

11. The apparatus as set forth in claim 8 further including means for causing the schematic representation means to repeat causing the paths to assume their more readily visible state a plurality of times.

12. The apparatus as set forth in claim 1 in which the audio response means produces audio sounds in coordination with contact between the figures and the playing piece, the audio means being operatively connected with the figure sensing means and the goal sensing means.

13. The apparatus as set forth in claim 12 wherein the audio response means includes means for producing a preselected audio sequence in response to the goal sensing means sensing the passage of the playing piece.

14. The apparatus as set forth in claim 13 wherein the audio response means further includes same means for producting a preselected audio sequence in response to a figure disposed closely adjacent the goal area contacting the playing piece.

15. The apparatus as set forth in claim 14 further including multiple save means for determining whether the figure closely adjacent the goal area contacts the playing piece a preselected plurality of times within a preselected time interval and producing a variable preselected audio response, whereby the audio means is adapted to produce a chant in support of a goalie under an increased rate of attack.

16. The apparatus as set forth in claim 14 wherein the audio means further includes means for sensing whether the figure closely adjacent the goal was the last figure to contact the playing piece before the playing piece entered the goal area and producing a preselected audio response thereto, whereby the audio means is adapted to boo a goalie who scores upon himself.

17. A mechanical action game apparatus comprising:

a generally planar playing surface;

a plurality of first figures mounted adjacent the playing surface for movement relative thereto, each first figure having a figure sensing means for electronically sensing interaction with a playing piece;

a plurality of second figures mounted adjacent the playing surface for movement relative thereto, each second figure having a figure sensing means for electronically sensing interaction with the playing piece;

first figure control means for controlling movement of the first figures relative to the playing surface such that the first figures are adapted to move the playing piece around the playing surface;

second figure control means for controlling movement of the second figures relative to the playing surface such that the second figures are adapted to move the playing piece around the playing surface, the first and second figure control means being disposed adjacent opposite ends of the playing surface, whereby the first and second figures are adapted to be moved by different players;

first goal means for defining a first goal area adjacent one end of the playing surface;

first goal sensing means for sensing passage of the playing piece into the first goal area;

second goal means for defining a second goal area adjacent a second end of the playing surface;

second goal sensing means for sensing passage of its playing piece into the second goal area;

path means for selectively defining a plurality of optically visible paths extending from at least some of the first figures to the first goal area and from the second figures to the second goal area, each path having a more readily visible state and a less readily visible state; and schematic representation means for action replay adapted to cause at least one of the paths to assume its more visible state in response to the goal sensing means sensing passage of the playing piece into one of the first and second goals, said means including scoring means for determining which figure last contacted the playing piece before the playing piece passed into one of the first and second goal areas and for directing said means to cause a path which extends between the last contacted player and the one goal area to assume its more visible state, said means being operatively connected with the first and second figure sensing means, the first and second goal sensing means, and the path means, whereby after each goal is scored a schematically represented replay is provided to show which figure scored.

18. The apparatus as set forth in claim 7 wherein the schematic representation means further includes assist means for determining the penultimate figure to contact the playing piece before the playing piece passed into the one goal area, the assist means being operatively connected with the first and second figure sensing means for sensing contact between the figures and the playing piece and being operatively connected with the path means for directing the path means to cause a path between the penultimate and the last contacted figure to assume its more readily visible state.

19. The apparatus as set forth in claim 18 wherein the schematic representation means further includes team means for determining whether the penultimate figure is in the same one of the first and second groups of figures as the last figure, the team means being operatively connected with the assist means for disabling the assist means from directing the path means to cause a path between the penultimate and last contacting figures to assume its more visible state when the last and penultimate figures are in a different one of the first and second groups, whereby only the scoring team is credited with an assist.

20. The apparatus as set forth in claim 19 further including audio means for producing audio sounds in variable coordination with preselected sequences and of rates of interactions between the playing piece, the first and second pluralities of figures, and the first and second goal sensing means.

* * * * *